US006942568B2

(12) United States Patent
Baerlocher

(10) Patent No.: US 6,942,568 B2
(45) Date of Patent: Sep. 13, 2005

(54) GAMING DEVICE HAVING SKILL AND DEXTERITY ELEMENT

(75) Inventor: Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 198 days.

(21) Appl. No.: 10/318,969

(22) Filed: Dec. 13, 2002

(65) Prior Publication Data

US 2004/0116173 A1 Jun. 17, 2004

(51) Int. Cl.[7] ..... A63F 9/22
(52) U.S. Cl. ..... 463/16; 463/20
(58) Field of Search ..... 463/16, 20

(56) References Cited

U.S. PATENT DOCUMENTS

| | | | | |
|---|---|---|---|---|
| 1,854,479 | A | | 4/1932 | Mills |
| RE19,764 | E | * | 11/1935 | Mills ..... 219/76.14 |
| 3,393,061 | A | | 7/1968 | Helm et al. |
| 4,363,485 | A | | 12/1982 | Edwall |
| 4,582,324 | A | | 4/1986 | Koza et al. |
| 4,618,150 | A | | 10/1986 | Kimura |
| 4,652,998 | A | | 3/1987 | Koza et al. |
| 4,695,053 | A | | 9/1987 | Vazquez, Jr. et al. |
| 4,743,024 | A | | 5/1988 | Helm et al. |
| 4,773,647 | A | | 9/1988 | Okada et al. |
| 5,116,055 | A | | 5/1992 | Tracy |
| 5,280,909 | A | | 1/1994 | Tracy |
| 5,308,065 | A | | 5/1994 | Bridgeman et al. |
| 5,340,317 | A | | 8/1994 | Freeman |
| 5,342,047 | A | | 8/1994 | Heidel et al. |
| 5,342,049 | A | | 8/1994 | Wichinsky et al. |
| 5,344,144 | A | | 9/1994 | Canon |
| 5,393,061 | A | | 2/1995 | Manship et al. |
| 5,411,271 | A | | 5/1995 | Mirando |
| 5,524,888 | A | | 6/1996 | Heidel |
| 5,536,016 | A | | 7/1996 | Thompson |
| 5,542,669 | A | | 8/1996 | Charron et al. |

(Continued)

FOREIGN PATENT DOCUMENTS

| | | |
|---|---|---|
| EP | 375190 | 6/1990 |
| EP | 0688002 | 12/1995 |
| GB | 2 097 160 | 12/1981 |
| GB | 2 096 376 A | 10/1982 |
| GB | 2 100 905 A | 1/1983 |
| GB | 2 137 392 A | 10/1984 |
| GB | 2 142 457 A | 1/1985 |
| GB | 2 144 644 | 3/1985 |
| GB | 2 153 572 A | 8/1985 |
| GB | 2 161 008 A | 1/1986 |
| GB | 2 161 009 A | 1/1986 |
| GB | 2 170 636 A | 8/1986 |
| GB | 2 180 682 A | 4/1987 |
| GB | 2 181 589 A | 4/1987 |
| GB | 2 183 882 A | 6/1987 |
| GB | 2 222 712 A | 3/1990 |
| GB | 2 226 436 A | 6/1990 |
| GB | 2 226 907 A | 7/1990 |
| GB | 2 262 642 A | 6/1993 |
| WO | WO/0012186 | 3/2000 |

OTHER PUBLICATIONS

Fey, Slot Machines, A Pictorial History of the First 100 Years, Liberty Belle Books, 1983, pp. 215, 219.*
The Inside Straight article written by IGT, published in 2002.
Cash Chameleon Article written by Aristocrat Technologies, published Apr., 2001.

(Continued)

*Primary Examiner*—Jessica Harrison
*Assistant Examiner*—Corbett Coburn
(74) *Attorney, Agent, or Firm*—Bell, Boyd & Lloyd LLC

(57) ABSTRACT

A gaming device is provided that requires the player to successfully perform a skill event and randomly receive a winning outcome to ultimately receive an award. The gaming device is suitable for gaming jurisdiction requiring skill.

41 Claims, 5 Drawing Sheets

U.S. PATENT DOCUMENTS 5,560,603 A 10/1996 Seelig et al.
5,611,730 A 3/1997 Weiss
5,645,486 A 7/1997 Nagao et al.
5,766,074 A 6/1998 Cannon et al.
5,769,716 A 6/1998 Saffari et al.
5,772,509 A 6/1998 Weiss
5,779,549 A * 7/1998 Walker et al. ..... 463/42
5,788,573 A 8/1998 Baerlocher et al.
5,823,873 A 10/1998 Moody
5,823,874 A 10/1998 Adams
5,833,536 A 11/1998 Davids et al.
5,848,932 A 12/1998 Adams
5,871,398 A 2/1999 Schneier et al.
5,873,781 A 2/1999 Keane
5,882,259 A 3/1999 Holmes et al.
5,882,261 A 3/1999 Adams
5,910,046 A 6/1999 Wada et al.
5,911,418 A 6/1999 Adams
5,941,770 A 8/1999 Miers et al.
5,951,397 A 9/1999 Dickinson
5,967,894 A 10/1999 Kinoshita et al.
5,997,401 A 12/1999 Crawford
6,015,346 A 1/2000 Bennett
6,019,369 A 2/2000 Nakagawa et al.
6,033,307 A 3/2000 Vancura
6,047,963 A 4/2000 Pierce et al.
6,050,895 A 4/2000 Luciano, Jr. et al.
6,056,642 A 5/2000 Bennett
6,071,192 A 6/2000 Weiss
6,089,976 A 7/2000 Schneider et al.
6,089,977 A 7/2000 Bennett
6,089,978 A 7/2000 Adams
6,102,798 A 8/2000 Bennett
6,110,039 A 8/2000 Oh
6,110,041 A 8/2000 Walker et al.
6,110,043 A 8/2000 Olsen
6,117,007 A 9/2000 Matsuyama et al.
6,117,008 A 9/2000 Machiguchi
6,120,031 A 9/2000 Adams
6,126,165 A 10/2000 Sakamoto
6,126,541 A 10/2000 Fuchs
6,126,547 A 10/2000 Ishimoto
6,135,884 A 10/2000 Hedrick et al.
6,135,885 A 10/2000 Lermusiaux
6,139,013 A 10/2000 Pierce et al.
6,142,873 A 11/2000 Weiss et al.
6,142,874 A 11/2000 Kodachi et al.
6,146,273 A 11/2000 Olsen
6,159,095 A 12/2000 Frohm et al.
6,159,097 A 12/2000 Gura
6,165,070 A * 12/2000 Nolte et al. ..... 463/20
6,174,233 B1 1/2001 Sunaga et al.
6,174,234 B1 1/2001 Seibert et al.
6,174,235 B1 1/2001 Walker et al.
6,190,255 B1 2/2001 Thomas et al.
6,203,010 B1 3/2001 Jorasch et al.
6,210,279 B1 4/2001 Dickinson
6,220,593 B1 4/2001 Pierce et al.
6,220,961 B1 4/2001 Keane et al.
6,224,482 B1 5/2001 Bennett
6,224,484 B1 5/2001 Okuda et al.
6,231,442 B1 5/2001 Mayeroff
6,231,445 B1 5/2001 Acres
6,234,897 B1 5/2001 Frohm et al.
6,238,288 B1 5/2001 Walker et al.
6,251,013 B1 6/2001 Bennett
6,261,177 B1 7/2001 Bennett
6,267,669 B1 7/2001 Luciano, Jr. et al.
6,270,409 B1 8/2001 Shuster
6,270,411 B1 8/2001 Gura et al.
6,287,194 B1 9/2001 Okada et al.
6,293,866 B1 9/2001 Walker et al.
6,302,790 B1 10/2001 Brossard
6,309,298 B1 10/2001 Gerow
6,309,299 B1 10/2001 Weiss
6,315,660 B1 11/2001 Demar et al.
6,364,768 B1 4/2002 Acres et al.
6,413,160 B1 7/2002 Vancura
6,416,409 B1 7/2002 Jordan
6,435,511 B1 8/2002 Vancura et al.
6,488,580 B1 12/2002 Robb
6,537,150 B1 3/2003 Luciano et al.
6,572,473 B1 6/2003 Baerlocher
6,761,632 B2 7/2004 Basenmer et al.
6,767,284 B1 7/2004 Koza
6,780,103 B2 8/2004 Bansemer et al.
2004/0116173 A1 6/2004 Baerlocher

OTHER PUBLICATIONS

Cyclone Advertisements, by Innovative Concepts in Entertainment, Inc., published before Dec. 2002.
Description of Gaming Machine with Animating Symbols.
Elvis Brochure and Elvis Article by IGT, published in 1999.
Introducing The Hottest Video Games on the Nile written by Aristocrat Technologies, published Oct., 2000.
Jackpot Party Brochure and Article published by WMS Gaming Inc. in 1998.
Mountain Coin Machine Distributing—Redemption Games—CycloneTM from www.mountaincoin.com printed Feb. 28, 2002.
Press Your Luck Article by Strictly Slots, dated 2000.
Primetime Amusements Redemption Games from www.primetimeamusements.com printed on Feb. 28, 2002.
Reel em In—Cast for Cash Brochure & Website published by WMS Gaming, Inc. in 2001.
Slotto Article by Strictly Slots, dated 2001.
Tickets'n'Tunes from www.rgb.com printed on Feb. 28, 2002.
Weiner Distributing ICE CycloneTM from www.weinerd.com printed on Feb. 28, 2002.
Winning Bid Brochure published by WMS Gaming, Inc. 2001.
Top Dollar Brochure written by IGT published in 1998.
Mikohn Ripley's Believe It or Not Article written by Strictly Slots published in 2001.
Description of Poker written by Hoyle's Rules of Games published 1946–1983.

* cited by examiner

GAMING DEVICE HAVING SKILL AND DEXTERITY ELEMENT

CROSS REFERENCES TO RELATED APPLICATIONS

The present invention relates to the following pending commonly owned U.S. patent applications: "Gaming Device Having Skill/Perceived Skill Bonus," Ser. No. 09/682,407, "Gaming Device Having Perceived Skill," Ser. No. 09/682,408, "Gaming Device Having a Progressive Award Funded Through Skill, Strategy, or Risk Dependent Gaming Event," Ser. No. 10/237,197,

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to gaming devices, and more particularly to gaming devices requiring player inputs.

Wagering machines in most jurisdictions are games of luck, not skill. For instance, slot machines owe at least some of their popularity to the fact that an amateur, novice or inexperienced player can play most slot machines at the player's own pace, with no required skills, strategy or risk evaluation and perform as well as the seasoned or experienced game player. Most slot machines are set to pay back on average between 80 and 99 percent of the amount that the players wager. These payouts are randomly determined. Nevertheless, players constantly try to inject skill, know-how or strategy into gaming devices with the hope of turning the odds in their favor.

Even though certain gaming machines such as video poker or blackjack involve certain skill, strategy and decision-making, their outcomes ultimately turn upon mathematics and probability. Other games such as double-up and offer and acceptance bonus games where a player puts at risk an award won to achieve a higher award also involve skill and strategy, but their outcomes ultimately turn upon mathematics and probability.

Certain wagering gaming devices are required to involve skill or dexterity. These games cannot turn purely upon the luck of the player. Skill games present certain problems to the game implementor. First, skill games can be mastered by players having a high level of skill, a lot of practice or both. Second, to combat the mastering, gaming device manufacturers may have to make the skill game relatively difficult for the economics to work. The difficulty level may be too great for average players to experience a sufficient level of success and enjoyment.

Skill games, on the other hand, are interactive and typically enjoyable to play. Accordingly, a need exists for a different, interactive and enjoyable game that can be played requiring skill or dexterity. A need also exists for a method of controlling a payout in a skill wagering game so that the skill event can be relatively easy to win and enjoy without relinquishing prohibitive payouts to those who master the skill event.

SUMMARY OF THE INVENTION

The present invention overcomes the shortfalls of the prior art by providing a game that requires the player to be successful at a skill event or a number of skill events to be eligible to win an award that is randomly generated. In one embodiment, the gaming device provides one skill event that the player must perform successfully to be eligible to win in a random event. In another embodiment, the gaming device provides multiple sequential skill events, wherein the player is required to perform one, a percentage of or all of the skill events successfully to be eligible for a win in a random event. The skill events include any suitable type of hand/eye coordination event, dexterity event or mental skill event including remembering, logically deducing, strategizing, or otherwise having knowledge, for example, knowledge of a trivia game or particular area of study. In one preferred embodiment, the skill event and the random event are independent of each other. In other words, the functioning of each event is not dependent on the other event.

The random event can be any suitable random game such as but not limited to slot, poker, keno, bingo, craps, blackjack and any combination thereof. The random event provides either a winning symbol, symbol combination or indicia outcome as is well known in the art. If the player plays the skill event successfully or plays a threshold level of skill events successfully, and the gaming device randomly generates a winning outcome for the player in the random event, the gaming device provides an award to the player based on the winning outcome. If the player does not perform the skill event successfully or does not achieve a randomly generated successful outcome in the random event, the player does not win an award. If the player successfully plays the skill event and the random event does not result in a winning outcome, the player does not receive any winning outcome. In an alternative embodiment, if the player plays the skill event successfully, but does not achieve a randomly generated successful outcome in the random event, the gaming device provides a consolation award. In a further alternative embodiment, if the player does not play the skill event successfully, but achieves a randomly generated successful outcome, the gaming device provides a consolation prize to the player.

The timing of the random generation event and the skill event or events can vary. In one embodiment, the skill event or events begin when the random generation begins and end roughly simultaneously. In another embodiment, either of the two may begin first and either last through the commencement of the other event or end before the other event begins. Any suitable alternative timing scheme for the skill and random events can be employed in accordance with the present invention. The present invention provides a fun and exciting way to add skill to an otherwise random wagering gaming device, and also enables the game implementer to set a relatively consistent payout percentage.

It is therefore an advantage of the present invention to provide a wagering gaming device that employs skill.

Another advantage of the present invention is to provide a wagering gaming device that can be played in jurisdictions requiring an element of skill.

Still another advantage of the present invention is to provide a wagering gaming device that combines skill and random outcomes.

Moreover, an advantage of the present invention is to provide a fun and exciting wagering gaming device that is interactive.

Still further, an advantage of the present invention is to provide a skill event for a wagering gaming device that is relatively easy to win and does not enable prohibitive payouts to be made to those who master the skill event.

Additional features and advantages of the present invention are described in, and will be apparent from, the following Detailed Description of the Invention and the figures.

DETAILED DESCRIPTION OF THE INVENTION

Figure 1A:
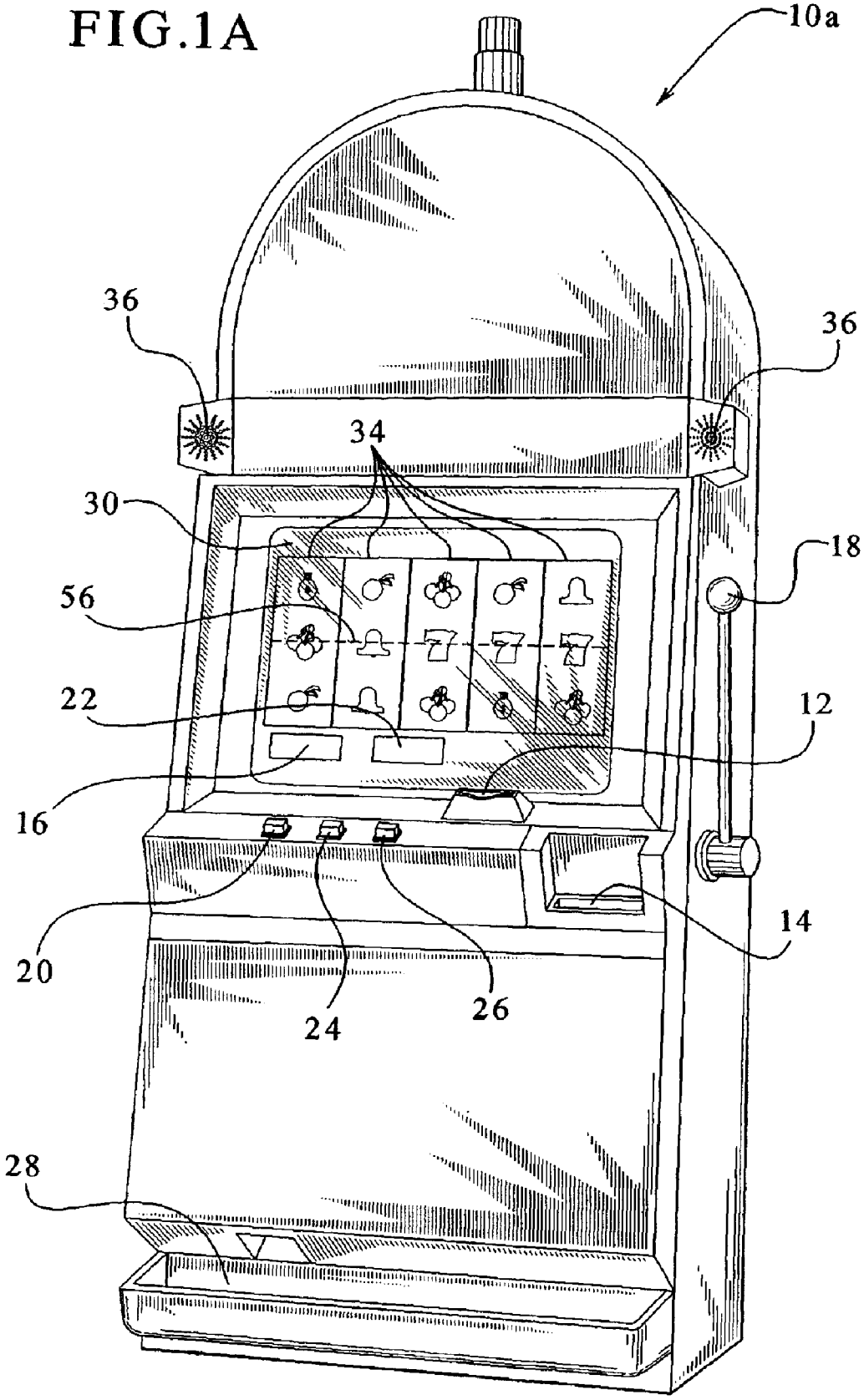
FIGS. 1A and 1B are perspective views of alternative embodiments of the gaming device of the present invention.
Figure 1B:
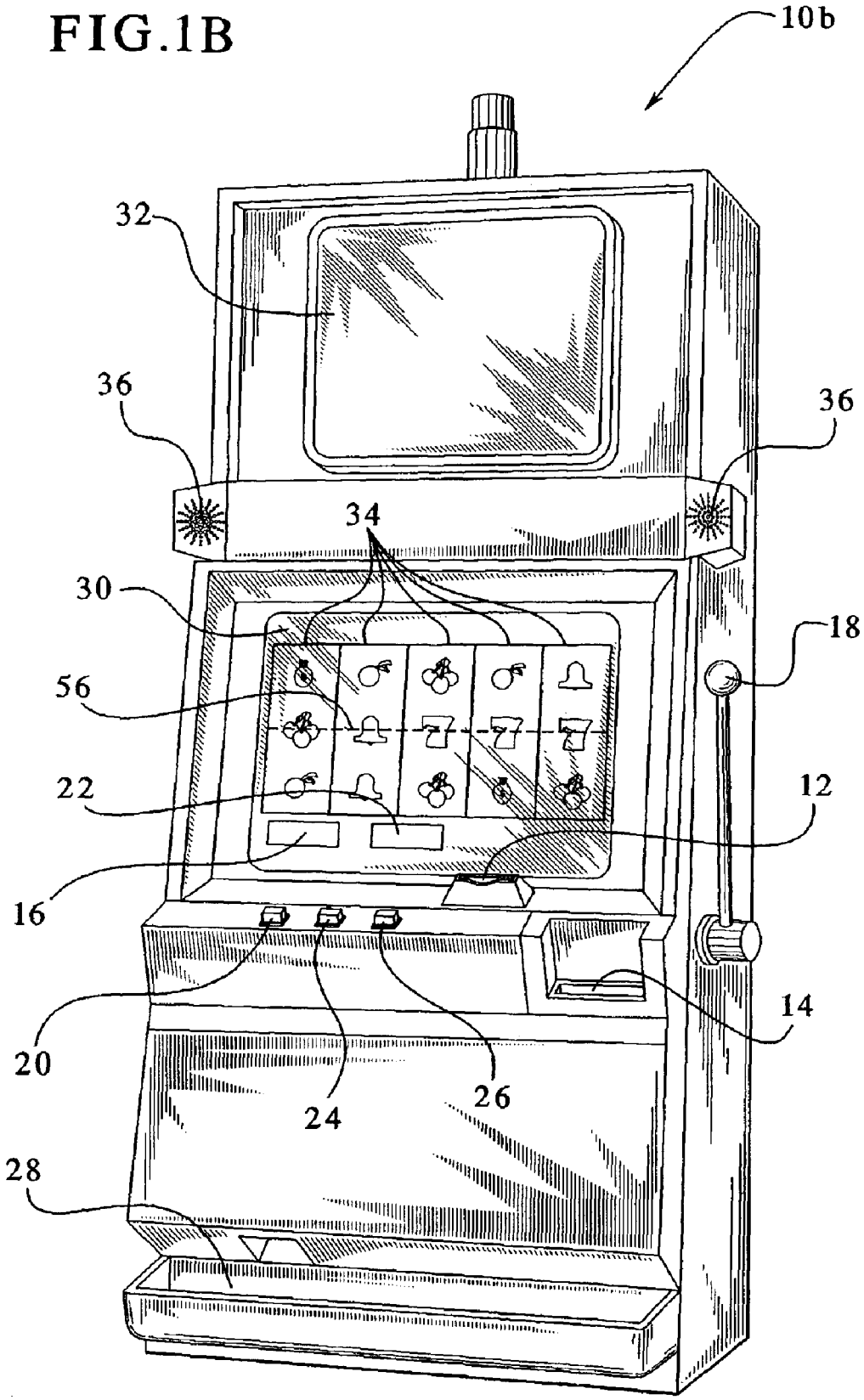

Referring now to the drawings, and in particular to FIGS. 1A and 1B, gaming device 10*a* and gaming device 10*b* illustrate two possible cabinet styles and display arrangements and are collectively referred to herein as gaming device 10. The gaming device of the present invention has the controls, displays and features of a conventional gaming machine. In various embodiments, the player operates gaming device 10 while standing or sitting. Gaming device 10 is alternatively a pub-style or table-top game (not shown), which a player preferably operates while sitting.

The gaming device 10, in certain embodiments, includes any suitable secondary or bonus triggering events, secondary bonus games as well as any progressive game coordinating with the primary or secondary games. Gaming device 10 also includes the symbols and indicia used for any of the base, bonus and progressive games include mechanical, electronic, electrical or video symbols and indicia.

The gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player begins the game by pulling arm 18 or pushing play button 20. Play button 20 includes any play activator used by the player, which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. A player may cash out by pushing a cash out button 26 to receive coins or tokens in the coin payout tray 28 or other forms of payment, such as an amount printed on a ticket or credited to a credit card, debit card or smart card. Ticket printing and card reading machines (not illustrated) are known by and commercially available to those of skill in the art.

Gaming device 10 also includes one or more display devices. The embodiment shown in FIG. 1A includes a central display device 30, and the alternative embodiment shown in FIG. 1B includes a central display device 30 as well as an upper display device 32. The display device includes any viewing surface such as glass, a video monitor or screen, a liquid crystal display or any other static or dynamic display mechanism.

The slot machine base game of gaming device 10 of one embodiment displays a plurality of reels 34, such as three to five reels 34, in video form on one or more of the display devices. Each reel 34 displays a plurality of indicia such as bells, hearts, fruits, numbers, letters, bars or other images or symbols which preferably correspond to a theme associated with the gaming device 10. The display device displaying the video reels 34 is preferably a video monitor.

Figure 2:
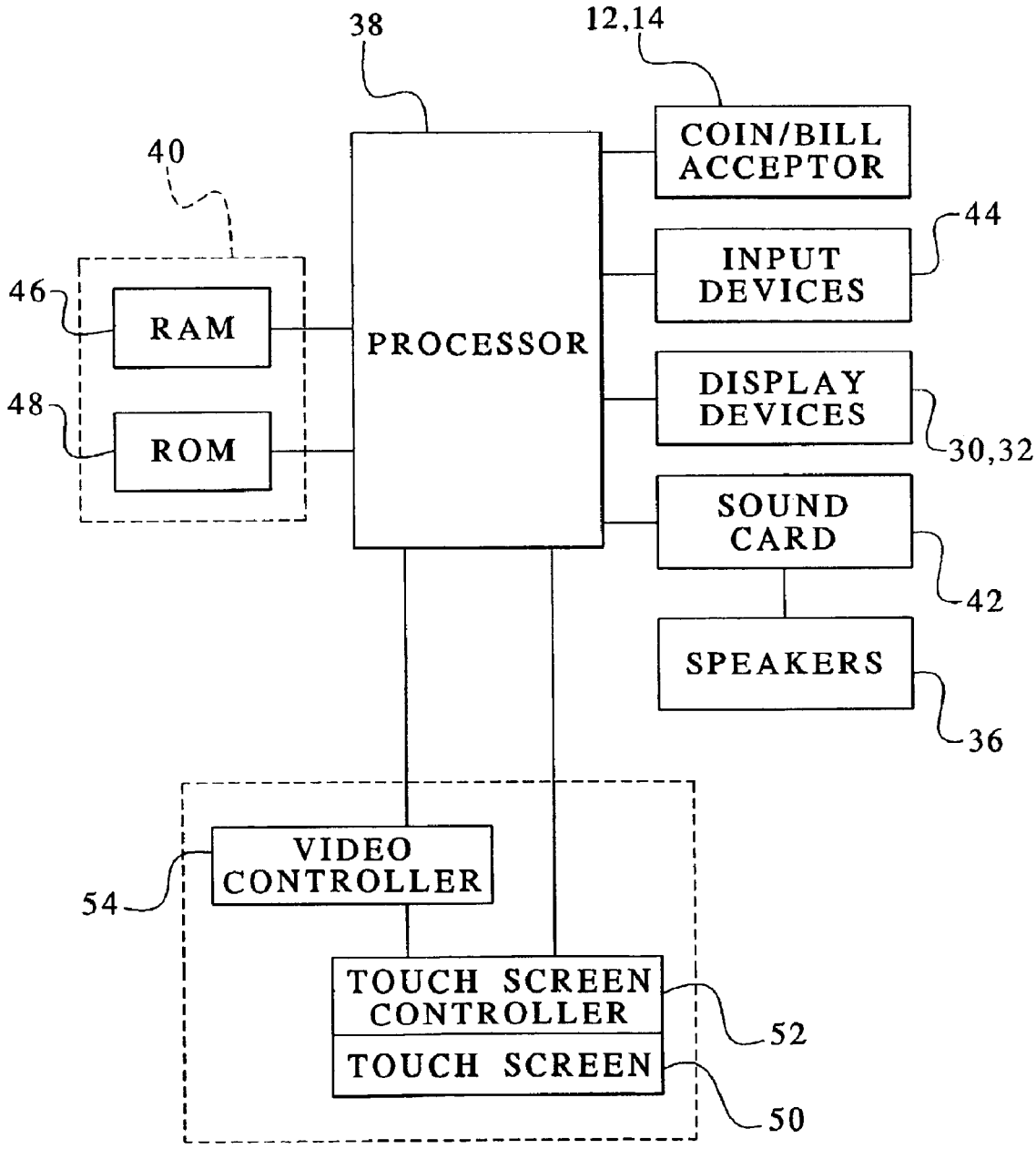
FIG. 2 is a schematic diagram of the electronic configuration of one embodiment of the gaming device of the present invention.

Referring now to FIG. 2, a general electronic configuration of the gaming device 10 preferably includes: a processor or central processing unit ("CPU") 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, objects, places and things. The memory device 40 includes random access memory ("RAM") 46 for storing event data or other data generated or used during a particular game. The memory device 40 also includes read only memory ("ROM") 48 for storing program code, which controls the gaming device 10 so that it plays a particular game in accordance with applicable game rules and paytables. The gaming device 10 includes speakers 36 for making sounds or playing music.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively or alternatively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like. The terms "computer" or "controller" are used herein to refer collectively to the processor 38, the memory device 40, the sound card 42, the touch screen controller and the video controller 54.

The gaming device 10 may include one or more bonus games that give players the opportunity to win credits. The gaming device 10 may employ a video-based display device 30 or 32 or a mechanical device (not shown) for the bonus games.

In the slot machine embodiment, the qualifying condition may include a particular symbol or symbol combination generated on a display device. As illustrated in the five reel slot game shown in FIGS. 1A and 1B, the qualifying condition includes the number seven appearing on, e.g., three adjacent reels 34 along a payline 56. It should be appreciated that the gaming device may include one or more paylines, such as payline 56, wherein the paylines can be horizontal, diagonal or any combination thereof. An alternative scatter pay qualifying condition includes the number seven appearing on, e.g., three adjacent reels 34 but not necessarily along a payline 56, appearing on any different set of reels 34 three times or appearing anywhere on the display device the necessary number of times.

Figure 3:
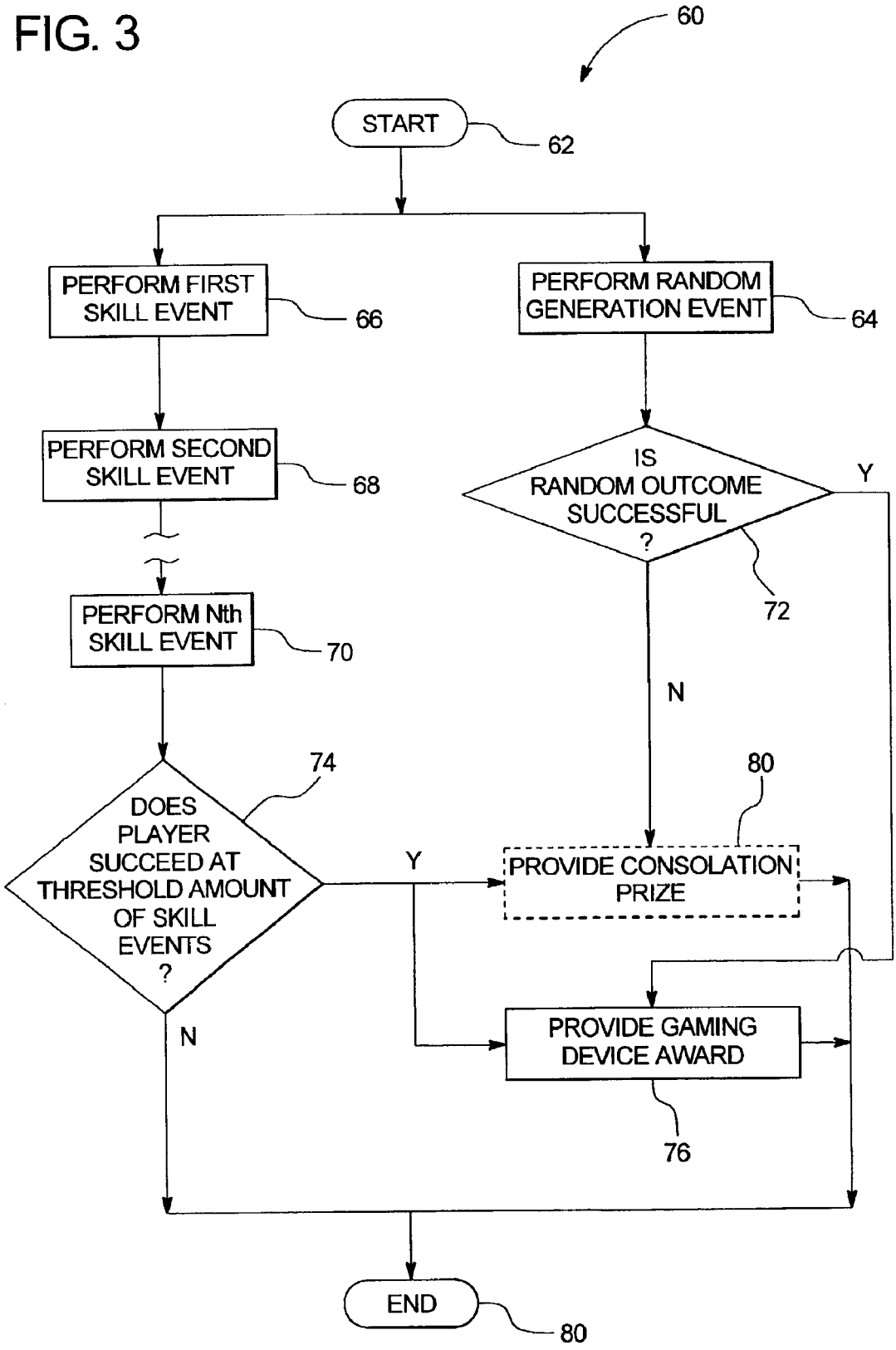
FIG. 3 is a process flow diagram illustrating various embodiments of the combined skill event and random generation event of the wagering gaming device of the present invention.

Referring now to FIG. 3, a method 60 illustrates various embodiments of the present invention. In general, the present invention enables the gaming device implementer to provide a skill game that has predictable payouts. As described above, one problem with skill wagering games is that certain players can master the game, while other players may never be able to win enough of the skill events to find the game enjoyable. If the gaming device implementer makes the skill event too difficult, not enough people will win and enjoy the gaming experience and play the game. If the gaming device implementer makes the skill event too easy, too many people will master the wagering game and the wagering game will become uneconomical to implement. The present invention solves this problem by combining an element of skill with a random generation event to produce a wagering game that requires the player to successfully perform a skill event and also receive a randomly generated successful outcome to obtain a win in the wagering game.

The skill event can be any suitable type of skill event that is displayed by a gaming device display and placed in a gaming establishment. The games can include skill events requiring dexterity, such as: (i) hitting a button at the right time; (ii) moving an object to the correct location; (iii) aiming an object properly; (iv) touching an input device with a correct amount of pressure or speed; (v) hitting an input device a correct amount of times; (vi) steering an object out of the way of oncoming objects or steering a moving object so that it does not hit objects in its path; or (vii) any combination of these.

In one embodiment, the skill event displays a row of moving bottles, wherein the player must press an input to shoot an aimed gun to hit one of the bottles. In another embodiment, the skill event requires the player to aim a gun, steer a car, aim a basketball shot, aim a baseball throw, etc., or maneuver any device having directional flexibility. The player's ability to time or aim within the skill event involves the player's ability to see and react (e.g., to push a button, steer a wheel, etc., correctly and at the right time). The skill event may further test the player's physical, yet non-motor skills such as a player's ability to hear and select a sound emanating from a particular location or speaker or to pay attention and listen for vital clues. The skill test may accordingly include a test of the player's knowledge, memory, mental ability, physical ability, motor skills, reflexes or any combination thereof.

The skill event can also include mental skill, such as: (i) remembering the location of an object or the content of an image (see below); (ii) answering a trivia question correctly; (iii) making a proper logical deduction, for example, deciding at an appropriate time to pull over for a pit-stop; (iv) making a proper or strategic decision, for example, keeping three of a kind in poker instead of attempting to draw a flush; (v) answering mathematical questions properly; or (v) any combination of these.

The mental skill event can require the player, for example, to count a plurality of items displayed within the event and to input a selection based on the resulting number. The mental skill event can require the player to perform a mathematical function such as adding, subtracting, multiplying or dividing a plurality of awards or a combination thereof and to make a selection based upon the resulting number.

In one embodiment, the mental skill event tests the player's mental ability to remember, read or use logical or abstract thinking. For example, the skill event can momentarily display a plurality of items or values and then require the player to remember where a particular item is located and to make a selection accordingly. In another example, the skill event includes a brief display of a plurality of numbers and a display that requires the player to remember and list the numbers. In a further example, the skill event includes the display of a plurality of symbols or items and a display that requires the player to visually match two or more symbols. In a further embodiment, the skill event may test the player's general knowledge or knowledge about specific areas of study or trivia.

Accordingly, the skill events require the player to act and/or think. The skill events require a decision by the player other than a guess or mere random selection. For example, choosing one of a plurality of masked values does not require skill. Choosing the one masked value having indicia that the game displayed a moment earlier, however, requires memory, alertness and keen eyesight and therefore requires skill.

Figure 4:
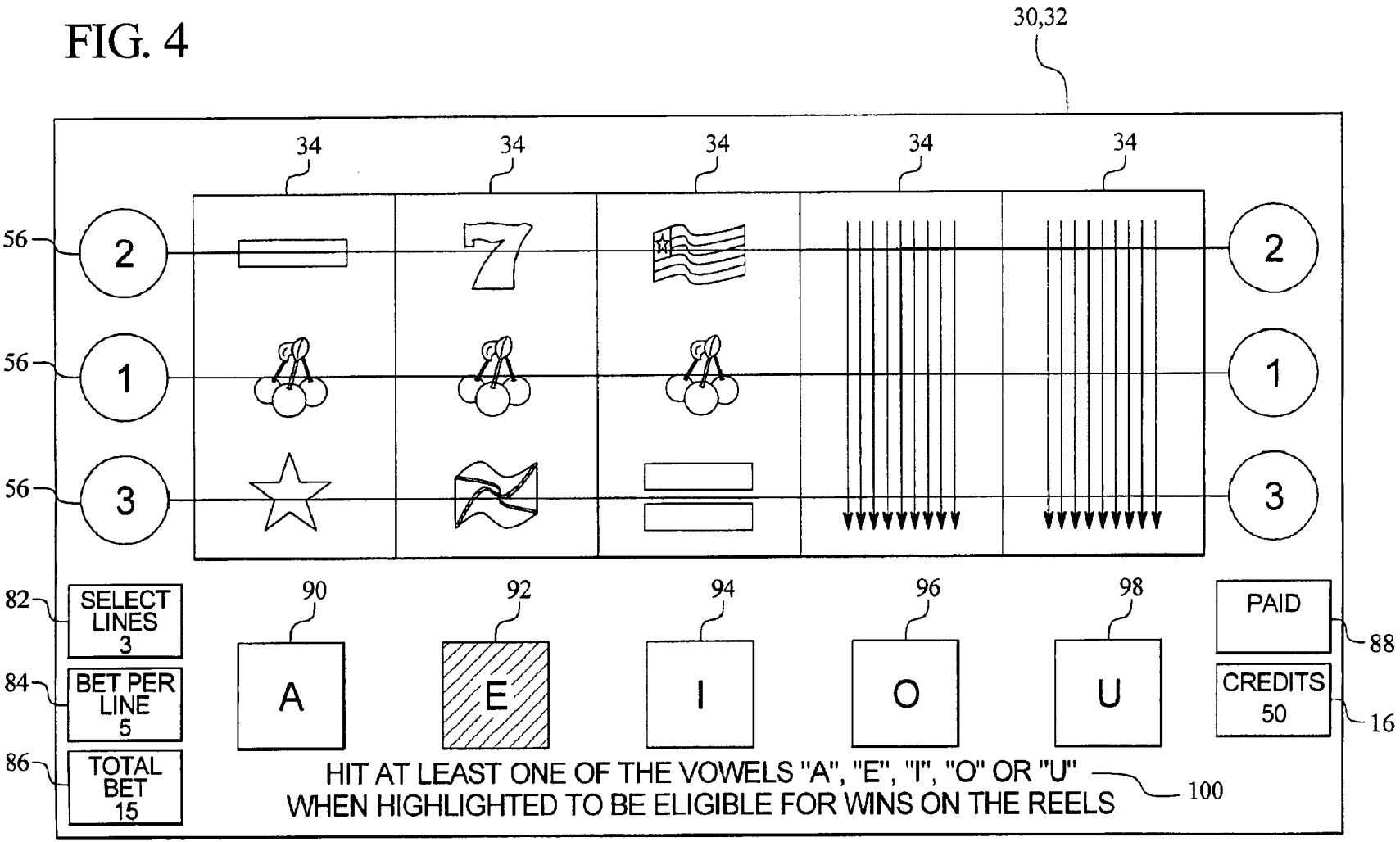
FIG. 4 is an elevation view of the display device of the present invention illustrating one slot machine embodiment of the skill event and random generation event of the gaming device of the present invention.

The random generation event that the gaming device 10 of the present invention combines with one of the above described skill events is any suitable random generation from a base or bonus game such as but not limited to slot, poker, blackjack, roulette, keno, bingo, craps, and any combination of these. A slot embodiment is illustrated in FIG. 4 and discussed below. In blackjack, the random event is the generation of one or more playing cards. Likewise in poker, the random event is the generation of a set of playing cards and then the generation of a second set if the player decides to exchange one or more of the cards from the first generated set of cards. In roulette, the random generation is a number. In keno and bingo, the random generation is a series of numbers. In craps, the random generation is the rolling of a pair of dice. Each of these types of example random generations or random event can be combined readily with the skill events described above in the manner set forth in method 60 illustrated in FIG. 3. The random generation event can also include multiple successful or unsuccessful outcomes. For example, a slot game can randomly generate an award for the player and also randomly initiate a bonus game or trigger a progressive win.

In one embodiment, the game of the present invention starts as indicated by oval 62. The starting of the game of the present invention includes the beginning of any base game, bonus game, progressive game or bonus game initiating event of the random generation game. The game of the present invention performs parallel tasks. First, as indicated by block 64, gaming device 10 performs a random generation event. The random generation event includes any of the events described above. At the same time, before the random generation event or after the random generation event, gaming device 10 begins the performance of a skill event as indicated by block 66. The skill event can be any of the skill events described above including a skill event requiring dexterity, aim or other type of physical skill or any of the mental skill events. The skill events are typically performed on a video monitor display device 30 or 32, but can alternatively include one or more electromechanical displays.

Gaming device 10 employing the method 60 in an embodiment includes only one skill event, however, gaming device 10 can employ a series of any suitable number of skill events. For this reason, the method 60 illustrates the performance of a second skill event as indicated by block 68 and the performance of an Nth skill event as indicated by block 70. The multiple skill events can occur simultaneously, or sequentially (i.e., one after another or be spaced apart over a period of time).

Typically, the random generation events described above occur over a period of time of seconds. For example, slot machine reels typically spin for two to four seconds. The dealing of cards typically takes one or two seconds. The roll of the dice can take several of seconds depending on how far the roller throws the dice. The skill events as indicated by blocks 66 to 70 in an embodiment are performed during the random generation event. For example, the skill events can occur while the dice are rolling on the craps table, while the reels are spinning or while a dealer's hand is dealing a card to the player. In another embodiment, the skill event occurs at least partially before the random generation event begins. For example, the skill event can occur before the generation of a bingo number or before the generation of a keno number. The skill event can extend into and even past the duration of the random generation event. For example, the skill event can begin before the spinning of a ball on a roulette wheel and end while the ball is still rolling, end simultaneously when the ball stops rolling on a number or end after the ball stops rolling on a number.

At a certain point in time, both the random event as indicated by block 64 and the one or more skill events as indicated by blocks 66 to 70 end and each result in either positive or negative outcome for the player. After the performance of the random generation event, gaming device 10 employing the method 60 determines whether the random outcome is successful using one of the rules set forth above for each of the random generation events described herein, as indicated by diamond 72.

For the random generation event, the successful or unsuccessful outcome is simply whether the random generation event yields an award winning symbol or combination of symbols or indicia. In a slot game, for example, certain symbols or combinations of symbols appearing along a payline that has been activated by a player yield a payout of credits, according to a paytable for the gaming device 10. In poker and blackjack, the random generation results in either a combination of playing cards that provides or does not provide a number of credits to the player. In craps, depending upon the player's wager, the combination of dice that face outward from a screen of gaming device 10 provide or do not provide a number of credits to the player. In bingo, the random generation can result in a successful combination of numbers for the player or an unsuccessful win by the gaming device 10 or other opponent.

The player succeeds at the skill event by properly or successfully performing the task of the skill event or a threshold or required number of tasks of the skill event. For example, success in a racing event is to control an object that crosses a finish line first or progresses to a certain distance or position in a preset amount of time. Success at a skill event can be aiming properly at an object, matching a number of objects correctly or otherwise successfully performing any of the above-described skill events.

Once each of the skill events is performed, wagering gaming device 10 employing the method 60 determines whether the player succeeded at a threshold amount of skill events as indicated by diamond 74. The threshold level is any level desired by the game implementer. For example, if only one skill event is performed, the threshold level is one. That is, the player must be successful at the single skill event in order to be eligible for an award. If the gaming device 10 provides a plurality of skill events as indicated by blocks 66 to 70, gaming device 10 can determine that the player is eligible for an award if the player is successful one time, any percentage of the skill events or in each of the events. For example, if the skill event involves shooting at glass bottles, gaming device 10 in an embodiment makes the player eligible for an award if the player hits only one bottle, if the player hits three out of five bottles or only if the player hits all give bottles, etc.

If the player succeeds at the threshold amount in the skill event as indicated by the positive outcome of diamond 74, the player becomes eligible for an award as indicated by block 76. In an alternative embodiment, the player also becomes eligible for a consolation prize as indicated by block 80. If the player receives a positive or successful outcome from the random generation event as indicated by the positive response to diamond 72, and the player meets the threshold amount of successful skill outcomes, gaming device 10 provides a gaming device award to the player as indicated by block 76. In one embodiment, if the player does not receive a positive or successful outcome from the random event, the method 60 of gaming device 10 ends as indicated by oval 78. In an alternative embodiment, if the player meets the threshold amount of successful outcomes from the skill event as indicated by diamond 74, but receives an unsuccessful outcome from the random generation event as indicated diamond 72, gaming device 10 provides the player a consolation prize as indicated by block 80.

It is also possible, although not illustrated, to provide a consolation award to the player if the player receives a successful outcome from the random generation event but does not succeed or succeed enough times in the one or more skill events. The illustrated method 60 shows that if the player does not meet the skill requirement, the method 60 of gaming device 10 ends as indicated by oval 78.

Referring now to FIG. 4, one embodiment of a slot machine employing the combined skill event and random generation event of gaming device 10 is illustrated. FIG. 4 illustrates one of the display devices 30 and 32 described above in connection with the FIGS. 1A and 1B. In the illustrated embodiment, the slot machine includes five reels 34 and three paylines 56. The present invention is operable with any suitable number of reels, preferably at least two reels, and at least one payline 56. It is common in the industry however to have slot machines with up to or more than twenty-five paylines.

Display device 30 or 32 includes a number of features commonly found on a slot machine, such as a select lines button 82, a bet per line button 84 and a total bet indicator 86. Each of these can be simulated in the areas of a touch screen 50 or otherwise be electromechanical pushbuttons or displays. In the illustrated embodiment, the player has selected all three lines as indicated by the select lines button 82, the player has wagered five credits per line as indicated by the bet per line button 84, giving the player a total bet of fifteen credits, as indicated by the total bet indicator 86.

Gaming device 10 also includes a credit display 16, showing that the player currently has fifty credits in addition to the fifteen credits that are currently being wagered. Gaming device 10 also includes a paid display 88 which shows the player a total number of credits won after any given spin of the reels 34. The displays device 30 or 32 also displays a number of simulated or electromechanical lightable inputs 90 to 98, which include the indicia "A," "E," "I," "O" and "U", respectively.

Gaming device 10 also provides a message 100 to the player, which can be a video message on the display device 30 or 32, an audio message or an audio-video message. The message 100 indicates to the player that, using a level of skill, the player must select one of the vowels 90, 92, 94, 96 or 98 when the vowel is lighted or highlighted to be eligible for a win that occurs along the slot machine reels 34. The slot machine reels 34 operate in any suitable manner desired by the game implementer. One popular way to operate the reels 34 is illustrated in FIG. 4, wherein the reels 34 all spin for a period of time, whereafter the reels stop one by one in sequence beginning with the first reel on the left, then the second reel from the left, then the third reel from the left, etc. FIG. 4 illustrates that the two right most reels are in mid spin, wherein the left most three reels have come to a stop, and wherein the right two most reels are still spinning and will come to a stop the second reel to the right first, then the right most reel.

During the spinning of the reels, gaming device 10 intermittently and sequentially highlights or lights one of the vowels 90 to 98. In another embodiment, gaming device 10 begins lighting the vowels 90 to 98 intermittently and sequentially before the spinning of the reels and in a further embodiment the highlighting can begin or continue after the reels have stopped spinning. In the illustrated embodiment, gaming device 10 is currently highlighting the vowel "E" while the reels are still spinning. The reels spin for a total number of seconds, for example, four seconds, wherein gaming device 10 in an embodiment highlights one of the vowels 90 to 98 for the first second, chooses another vowel to highlight for the next second, chooses a third vowel to highlight for the third second and chooses a fourth vowel to highlight for the forth second when the reels stop spinning.

In an embodiment, the vowels are highlighted randomly, so that the player cannot predict which vowel will be highlighted next. Further, gaming device 10 provides five vowels when only four will be lit so that the player is precluded from simply touching two vowels at the same time, knowing that gaming device 10 eventually will highlight one of the two vowels. Other methods for preventing such action by the player may be employed in accordance with the present invention. In an embodiment, the gaming device 10 can randomly generate one of the vowels twice. In another embodiment, gaming device 10 is precluded from generating any of the vowels 90 to 98 more than one time. Other embodiments may be employed in accordance with the present invention to make it harder or easier for the player in the skill event.

If the player selects one of the values while it is lit, the player becomes eligible for an award occurring along an active payline. For example, payline one illustrates three cherries, which gaming device 10 stores as a set of symbols that provides a payout to the player. In the illustrated embodiment, if the player touches the letter "E" while it is still highlighted, the player obtains the number of credits provided by the winning combination of three cherries. If the player fails to touch the letter "E" while it is highlighted and also fails to touch any of the other vowels while they are highlighted, the player does not obtain the payout for the three cherries combination. In alternative embodiments, gaming device 10 requires that the player touch each of the vowels while they are highlighted or any percentage of a total number of highlighted values.

Highlighting a vowel 90 to 98 for one second provides a skill game that most players with even a rudimentary level of hand/eye coordination can play successfully. The payout percentage, however, is controlled by the random generation of the symbols. The implementer can determine that players on average exhibit the threshold level of skill 90% of the time and therefore increase the random outcome winning percentage by, for example, 10% knowing that the game will not payout a random winning outcome 10% of the time.

The duration of time that each vowel 90 to 98 is highlighted is variable. The total number of vowels displayed is also variable. The time interval between sequential highlighting of the vowels can be varied as can the overall threshold of successful outcomes that the player must have to be eligible for the award. The duration of highlighting and the time interval between skill events can also vary during the same overall skill event or set of skill events.

It should be appreciated that the gaming device of the present invention may provide appropriate audio, visual and/or audio-visual messages to the player to keep the player informed as to the status of the game including the random events and the skill events. For instance, upon the occurrence of a successful outcome in a skill event, the gaming device could display a message that the player won the skill event and now is eligible to receive a or any successful outcome of the random event. Likewise, upon the occurrence of a successful outcome in the random event, the gaming device could display an audio, visual or audio-visual message that the player won the random event and the associated award and will receive such award if the player is successful in the skill event. Alternatively, unsuccessful outcome messages can be provided to the player. It should be appreciated that in one alternative embodiment, if one event is unsuccessful, the other event may be terminated prior to ending, or may be terminated by the player upon input by the player.

It should also be appreciated that in an alternative embodiment, the number of successful outcomes in one or more skill events could determine the number of or type of successful outcomes in the random event which the player is eligible to receive.

It should also be appreciated that in one embodiment, if one or a threshold number of successful outcomes in the skill event(s) are achieved by the player, the gaming device could terminate the remaining part of the skill event(s). In a further alternative embodiment, the remaining part of the skill event(s) could be employed to determine another gaming device function such as a bonus award or a trigger to a bonus game. The amount of the award provided to the player can thus, at least partially, be based on the player's success in the skill event. For instance, if a player achieves a certain threshold, the award could be multiplied by a suitable factor or multiple such as 2× or 3×.

It should also be appreciated that the present invention contemplates various combinations of skill and random events to determine a win in a game such as multiple random or skill events or both multiple random and skill events. In this embodiment, different successes or combination of successes could determine different awards.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A wagering gaming device comprising:

a random generation event operable upon a wager by a player and having a randomly generated successful outcome and a randomly generated unsuccessful outcome;

a skill event requiring the player input and having a successful skill outcome and an unsuccessful skill outcome based on the player input, wherein the player input occurs before the end of the random generation event; and an award provided to the player if the player achieves both the randomly generated successful outcome and the successful skill outcome, wherein the award value is based upon said randomly generated successful outcome without regard to said successful skill outcome.

2. The gaming device of claim 1, wherein the randomly generated event is selected from the group consisting of: a spinning of at least one slot machine reel, a generation of at least one card, a generation of at least one die face, a generation of at least one number, a generation of at least one color, a generation of at least one symbol, and any combination thereof.

3. The gaming device of claim 1, wherein the randomly generated event includes a random generation of a plurality of symbols.

4. The gaming device of claim 1, wherein the player input is selected from the group consisting of: an area on a touch screen, an electromechanical input device, an object that becomes highlighted on a display device for a period of time and any combination thereof.

5. The gaming device of claim 1, wherein the skill event is selected from the group consisting of: a testing of the player's knowledge, a testing of the player's memory, a testing of the player's motor skills, a testing of the player's reflexes, and any combination thereof.

6. The gaming device of claim 1, which includes a processor that coordinates the playing of the skill event and the random generation event.

7. The gaming device of claim 1, which includes a display device that displays at least one of the skill event and the random generation event.

8. The gaming device of claim 1, which includes a plurality of display devices, wherein one of the display devices displays the skill event and one of the display devices displays the random generation event.

9. The gaming device of claim 1, which includes a display device that simultaneously displays the skill event and the random generation event.

10. The gaming device of claim 1, which includes a consolation award provided to the player if the player achieves the successful skill outcome and the randomly generated unsuccessful outcome.

11. The gaming device of claim 1, which includes a consolation award provided to the player if the player achieves the unsuccessful skill outcome and the randomly generated successful outcome.

12. A wagering gaming device comprising:

a random generation event operable upon a wager by a player and having a randomly generated successful outcome and a randomly generated unsuccessful outcome;

a skill event requiring the player input and having a successful skill outcome and an unsuccessful skill outcome based on the player input, wherein the random generation event and the skill event begin substantially simultaneously; and an award provided to the player if the player achieves both the randomly generated successful outcome and the successful skill outcome, wherein the award value is based upon said randomly generated successful outcome without regard to said successful skill outcome.

13. A wagering gaming device comprising:

a random generation event operable upon a wager by a player and having a randomly generated successful outcome and a randomly generated unsuccessful outcome;

a skill event requiring the player input and having a successful skill outcome and an unsuccessful skill outcome based on the player input, wherein one of the random generation event and the skill event ends before the other event ends; and an award provided to the player if the player achieves both the randomly generated successful outcome and the successful skill outcome, wherein the award value is based upon said randomly generated successful outcome without regard to said successful skill outcome.

14. A wagering gaming device comprising:

a random generation event operable upon a wager by a player and having a randomly generated successful outcome and a randomly generated unsuccessful outcome;

a skill event requiring the player input and having a successful skill outcome and an unsuccessful skill outcome based on the player input; and an award provided to the player if the player achieves both the randomly generated successful outcome and the successful skill outcome, wherein no award is provided to the player if the player achieves one of the randomly generated successful outcome and the successful skill outcome without achieving the other of the randomly generated successful outcome and the successful skill outcome, wherein the award value is based upon said randomly generated successful outcome without regard to said successful skill outcome.

15. A wagering gaming device comprising:

a random generation event having a randomly generated successful outcome and a randomly generated unsuccessful outcome;

a skill event requiring a player input and having a successful skill outcome and an unsuccessful skill outcome based on the player input; and an award provided to the player if the player achieves both the randomly generated successful outcome and the successful skill outcome, wherein no award is provided to the player if the player achieves: (a) both the randomly generated successful outcome and the unsuccessful skill outcome; (b) both the randomly generated unsuccessful outcome and the successful skill outcome; or (c) both the randomly generated unsuccessful outcome and the unsuccessful skill outcome, wherein the award value is based upon said randomly generated successful outcome without regard to said successful skill outcome.

16. A wagering gaming device comprising:

a random generation event which occurs upon a wager by a player and which determines an award for the player, if any;

an input device;

a skill event having a successful skill outcome and an unsuccessful skill outcome based on an input by the player using the input device; and a processor operable to control the random generation event and the input device, wherein if the random generation event generates an award, the processor provides said award to the player if the player achieves the successful skill outcome in the skill event, wherein the award value is based upon said randomly generated successful outcome without regard to said successful skill outcome.

17. The gaming device of claim 16, wherein the successful outcome includes a selection of a particular input from a plurality of inputs of the input device.

18. The gaming device of claim 16, which includes a plurality of skill events, wherein the successful outcome includes a selection of a particular input from a plurality of inputs of the input device in any one of said skill events.

19. The gaming device of claim 16, which includes a plurality of skill events, wherein the successful outcome includes a selection of a particular input from a plurality of inputs of the input device in a threshold percentage of the skill events.

20. The gaming device of claim 16, wherein the successful outcome includes a selection of an input of the input device at a particular point in time.

21. The gaming device of claim 16, wherein the input device includes a lighted mechanical device.

22. The gaming device of claim 16, which includes a plurality of skill events, wherein the successful outcome includes a selection of an input from the input device at a particular point in time in any one of the skill events.

23. The gaming device of claim 16, which includes a plurality of skill events, wherein the successful outcome includes a selection of an input from the input device at a particular point in time in a threshold percentage of the skill events.

24. The gaming device of claim 16, wherein the input by the player occurs prior to an end of the random generation event.

25. The gaming device of claim 16, wherein the random generation event and the skill event begin substantially simultaneously.

26. A wagering gaming device comprising:

a random generation event operable upon a wager by a player and having at least one randomly generated successful outcome and at least one randomly generated unsuccessful outcome;

a skill event requiring at least one player input and having at least one successful skill outcome and at least one unsuccessful skill outcome based on the at least one player input, wherein at least one player input occurs before the end of the random generation event; and an award provided to the player if the player achieves both a threshold amount of the successful skill outcomes and at least one of the randomly generated successful outcomes, wherein the award value is based upon said randomly generated successful outcome without regard to said successful skill outcome.

27. The gaming device of claim 26, wherein the threshold amount is one successful skill outcome.

28. The gaming device of claim 26, wherein the threshold amount is a predetermined percentage of successful skill outcomes in relation to a total amount of player inputs.

29. A wagering gaming device comprising:

a random generation event operable upon a wager by a player and having a plurality of randomly generated successful outcomes and a plurality of randomly generated unsuccessful outcomes;

a skill event requiring at least one player input and having at least one successful skill outcome and at least one unsuccessful skill outcome based on the at least one player input, wherein at least one player input occurs before the end of the random generation event; and an award provided to the player if the player achieves both a threshold amount of the successful skill outcomes and at least one of the randomly generated successful outcomes, wherein the award value is based upon said randomly generated successful outcome without regard to said successful skill outcome.

30. The wagering gaming device of claim 29, wherein the random generation event includes the spinning of a plurality of reels having a plurality of symbols thereon, said plurality of randomly generated successful outcomes include a plurality of symbol combinations on the reels and the plurality of randomly generated unsuccessful outcomes includes a different plurality of symbol combinations on the reels.

31. The wagering gaming device of claim 29, wherein the random generation event includes a card game including plurality of cards, said plurality of randomly generated successful outcomes include a plurality of card combinations and the plurality of randomly generated unsuccessful outcomes includes a different plurality of card combinations.

32. The wagering game of claim 31, wherein the card game is selected from the group consisting of: poker and blackjack.

33. The wagering gaming device of claim 29, wherein the random generation event includes a dice game including a plurality of dice, said plurality of randomly generated successful outcomes include a plurality of dice face combinations and the plurality of randomly generated unsuccessful outcomes includes a different plurality of dice face combinations.

34. The wagering game of claim 33, wherein the dice game includes craps.

35. A wagering gaming device comprising:

a random generation event operable upon a wager by a player and having a randomly generated successful outcome and a randomly generated unsuccessful outcome;

a skill event requiring a player input and having a one successful skill outcome an unsuccessful skill outcome based on the player input, wherein the random generation event and the skill event are independent of each other but at least partially overlap in time; and an award provided to the player if the player achieves both the randomly generated successful outcome and the successful skill outcome, wherein the award value is based upon said randomly generated successful outcome without regard to said successful skill outcome.

36. A method of operating a gaming device having a wagering game including a random generation event and a skill event, said method comprising:

(a) displaying both the random generation and the skill event to the player upon receipt of a wager by a player; and (b) enabling the player to play both the random event and the still event, and (c) controlling a payout percentage of the wagering game by making an award provided to a player contingent upon the player both successfully performing the skill event and receiving a randomly generated successful outcome in the random generation event, wherein the award value is based upon said randomly generated successful outcome without regard to said successful skill outcome.

37. The method of claim 36, which includes ending the skill event before ending the random generation event.

38. The method of claim 36, which includes providing a plurality of skill events during the random generation event.

39. The method of claim 36, wherein the random generation event is selected from the group consisting of: spinning at least one reel, dealing at least one card, rolling at least one die, generating at least one number, generating at least one color generating at least one symbol and any combination thereof.

40. The method of claim 36, wherein the steps (a) to (c) are provided via a data network.

41. The method of claim 40, wherein the data network is an internet.

* * * * *